US010930425B2

(12) United States Patent
Kim

(10) Patent No.: US 10,930,425 B2
(45) Date of Patent: Feb. 23, 2021

(54) INDUCTOR

(71) Applicant: SAMSUNG ELECTRO-MECHANICS CO., LTD., Suwon-Si (KR)

(72) Inventor: Young Sun Kim, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 269 days.

(21) Appl. No.: 15/972,788

(22) Filed: May 7, 2018

(65) Prior Publication Data

US 2019/0122807 A1 Apr. 25, 2019

(30) Foreign Application Priority Data

Oct. 25, 2017 (KR) ..... 10-2017-0139111
Jan. 3, 2018 (KR) ..... 10-2018-0000826

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 27/29* (2013.01);
(Continued)

(58) Field of Classification Search
CPC ..... H01F 27/28004; H01F 41/041; H01F 41/042; H01F 17/0006; H01F 27/29;
(Continued)

(56) References Cited

U.S. PATENT DOCUMENTS 6,185,068 B1 * 2/2001 Fujita ..... G11B 5/313 360/123.41
6,369,983 B1 * 4/2002 Hong ..... G11B 5/313 360/123.49
(Continued)

FOREIGN PATENT DOCUMENTS

CN 106205956 A 12/2016
JP 02165406 A * 6/1990
(Continued)

OTHER PUBLICATIONS

Japanese Office Action dated Oct. 16, 2018 issued in Japanese Patent Application No. 2018-090988 (with Engish translation).
(Continued)

*Primary Examiner* — Alexander Talpalatski
*Assistant Examiner* — Joselito S. Baisa
(74) *Attorney, Agent, or Firm* — Morgan, Lewis & Bockius LLP

(57) ABSTRACT

An inductor may include a body and external electrodes on respective external surfaces of the body. The body may include a support member, an insulator on the support member and including a first opening, a coil in the first opening, and a thin film conductor layer between the coil and the support member. The thin film conductor layer may include a second opening, and one or both of its end portions may be between the support member and the insulator.

17 Claims, 8 Drawing Sheets

(51) Int. Cl.

| | |
|---|---|
| ***H01F 27/29*** | (2006.01) |
| ***H01F 27/32*** | (2006.01) |
| ***H01F 17/00*** | (2006.01) |
| *H01F 41/04* | (2006.01) |
| *H01F 17/04* | (2006.01) |

(52) U.S. Cl.
CPC ..... *H01F 27/292* (2013.01); *H01F 27/324* (2013.01); *H01F 27/327* (2013.01); *H01F 41/042* (2013.01); *H01F 2017/0073* (2013.01); *H01F 2017/048* (2013.01); *H01F 2027/2809* (2013.01)

(58) Field of Classification Search
CPC .... H01F 27/292; H01F 27/323; H01F 27/327; H01F 2027/2809
USPC ..... 336/200
See application file for complete search history.

(56) References Cited

U.S. PATENT DOCUMENTS

| | | | | |
|---|---|---|---|---|
| 9,490,062 | B2 * | 11/2016 | Yoon | H01F 17/0013 |
| 9,595,384 | B2 * | 3/2017 | Nakamura | H01F 17/0013 |
| 9,978,501 | B2 * | 5/2018 | Jeong | H01F 41/0233 |
| 10,515,752 | B2 * | 12/2019 | Choi | H01F 27/323 |
| 10,559,417 | B2 | 2/2020 | Ohkubo et al. | |
| 10,650,948 | B2 * | 5/2020 | Kim | H01F 5/00 |
| 2006/0152321 | A1 * | 7/2006 | Jung | H01F 17/0006 336/200 |
| 2014/0002226 | A1 * | 1/2014 | Moon | H01F 27/292 336/200 |
| 2015/0035634 | A1 | 2/2015 | Nakamura et al. | |
| 2015/0042415 | A1 | 2/2015 | Hurwitz et al. | |
| 2015/0102889 | A1 * | 4/2015 | Choi | H01F 17/0013 336/200 |
| 2016/0071643 | A1 * | 3/2016 | Heo | H01F 41/041 336/200 |
| 2016/0078998 | A1 * | 3/2016 | Park | H01L 23/5227 336/105 |
| 2016/0336105 | A1 | 11/2016 | Choi et al. | |
| 2016/0351316 | A1 | 12/2016 | Ohkubo et al. | |

FOREIGN PATENT DOCUMENTS

| | | | |
|---|---|---|---|
| JP | H07-211571 | A | 11/1995 |
| JP | H09-153406 | A | 10/1997 |
| JP | 2015-032625 | A | 2/2015 |
| JP | 2016-225465 | A | 12/2016 |
| KR | 10-1999-0066108 | A | 8/1999 |
| KR | 10-2015-0018333 | A | 2/2015 |
| KR | 10-2016-0132593 | A | 11/2016 |
| KR | 10-2016-0140487 | A | 12/2016 |
| KR | 10-2017-0073554 | A | 6/2017 |

OTHER PUBLICATIONS

Office Action issued in corresponding Korean Application No. 10-2018-0000826, dated Apr. 13, 2019.
Office Action issued in corresponding Chinese Patent Application No. 201810743679.1 dated Sep. 3, 2020, with English translation.

* cited by examiner

INDUCTOR

CROSS-REFERENCE TO RELATED APPLICATION(S)

This application claims benefit of priority to Korean Patent Application Nos. 10-2017-0139111 filed on Oct. 25, 2017 and 10-2018-0000826 filed on Jan. 3, 2018 in the Korean Intellectual Property Office, the disclosure of which is incorporated herein by reference in its entirety.

BACKGROUND

1. Field

The present disclosure relates to an inductor, and more particularly, to a power inductor advantageous for high inductance and miniaturization.

2. Description of Related Art

In accordance with the development of information technology (IT), products have been rapidly miniaturized and thinned and the demand for small thin components has thus increased.

Korean Patent Laid-Open Publication No. 10-1999-0066108 provides a powder inductor including a board having a via hole and coils disposed on both surfaces of the board and electrically connected to each other by the via hole of the board so as to be suitable for the technical trend, thereby making an effort to provide an inductor including coils having an uniform and high aspect ratio.

SUMMARY

An aspect of the present disclosure may provide an inductor including a coil pattern having a high aspect ratio by allowing a plurality of coil patterns to have a fine line width.

According to an aspect of the present disclosure, an inductor may include a body and external electrodes on respective external surfaces of the body. The body may include a support member, an insulator on the support member and including a first opening, a coil in the first opening, and a thin film conductor layer between the coil and the support member and including a second opening. At least one end portion of the thin film conductor layer is between the support member and the insulator. The insulator includes first and second insulators adjacent to each other across the first opening. The deviation between a thickness H1 of the coil at the first insulator and a thickness H2 of the coil at the second insulator is equal to or less than 15% of an average thickness of the coil.

According to another aspect of the present disclosure, an inductor may include a body and external electrodes on respective external surfaces of the body. The body may include a support member, an insulator on the support member and including a first opening, a coil in the first opening, and a thin film conductor layer between the coil and the support member and including a second opening. Both end portions of the thin film conductor layer may be covered with the insulator and between the support member and the insulator.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Inductors according to exemplary embodiments in the present disclosure will be described, but are not necessarily limited thereto.

First Exemplary Embodiment

Figure 1:
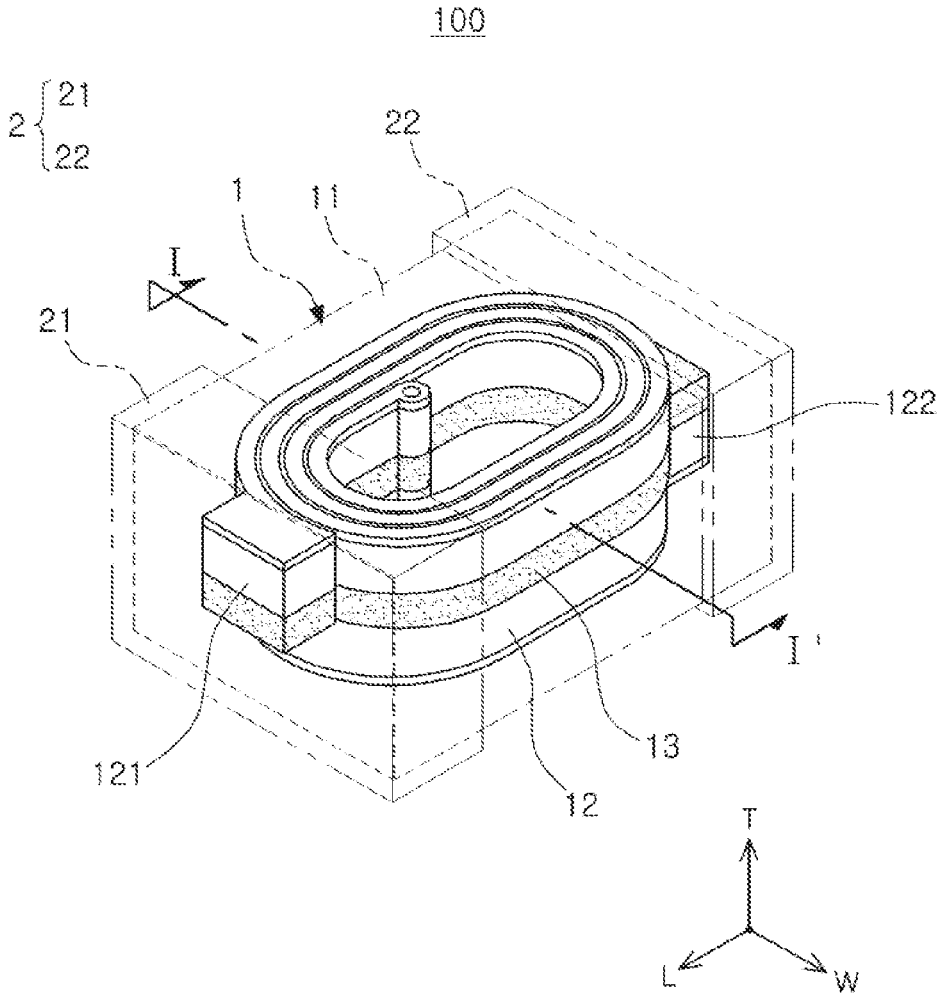
FIG. 1 is a schematic perspective view of an inductor according to a first exemplary embodiment in the present disclosure.
Figure 2:
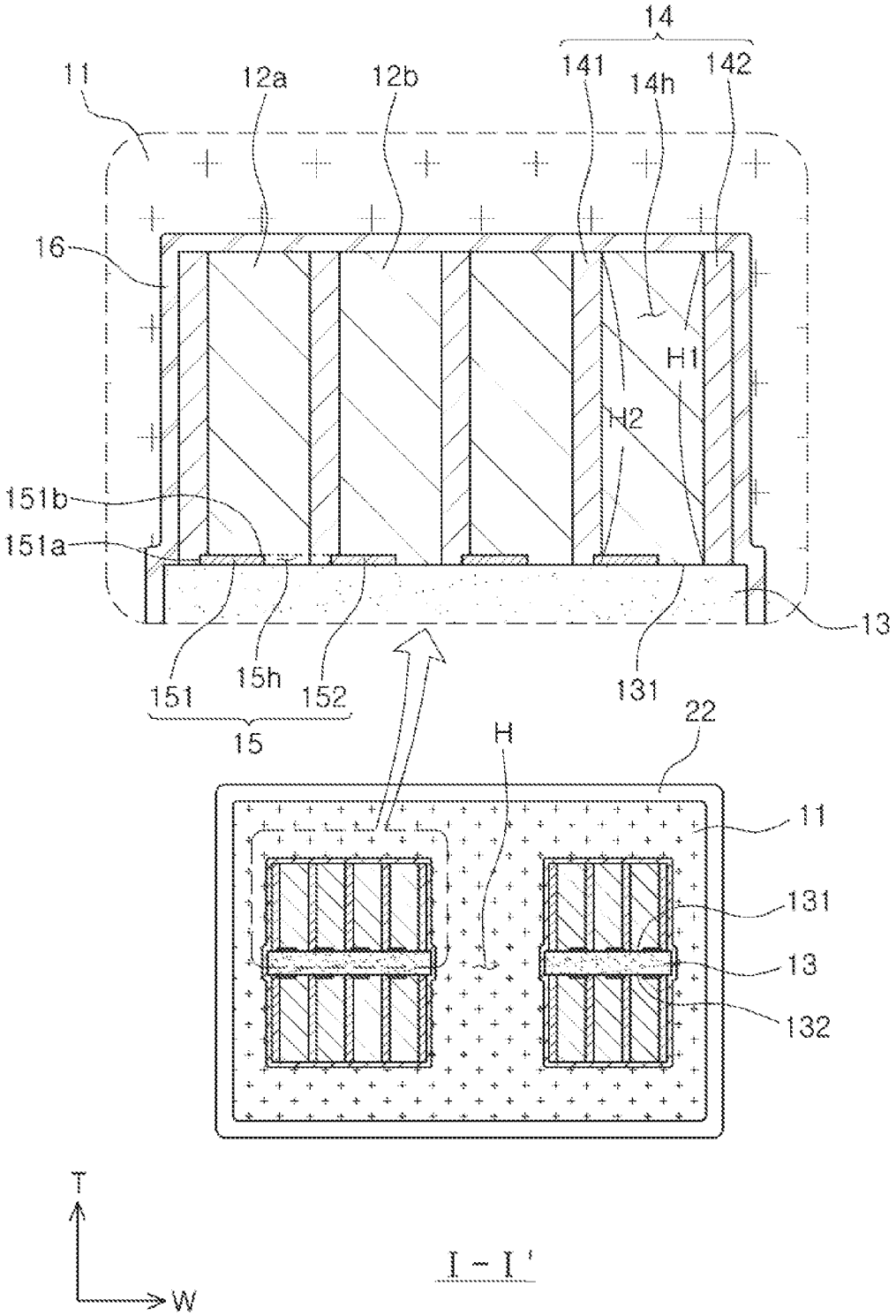
FIG. 2 is a cross-sectional view taken along line I-I' of FIG. 1.

FIG. 1 is a schematic perspective view illustrating an inductor according to an exemplary embodiment in the present disclosure. FIG. 2 is a cross-sectional view taken along line I-I' of FIG. 1.

Referring to FIGS. 1 and 2, an inductor 100 may include a body 1 and external electrodes 2 disposed on an external surface of the body.

The external electrodes 2 may comprise first and second external electrodes 21 and 22. When the first external electrode is an input terminal, the second external electrode may be an output terminal. Although the first and second external electrodes are illustrated as having a "C" shape in FIG. 1, the shape of the first and second external electrodes is not limited thereto. For example, the cross-sectional shape of the first and second external electrodes may be selected by those skilled in the art into a suitable cross-sectional shape, for example, an "L" shape or an "I" shape so as to be disposed on only one or two surfaces of the body. The first and second external electrodes contain a conductive material and may include Cu pre-plating layers or Ag-epoxy composite layers.

The body 1 may form an exterior of the inductor. The body may have first and second end surfaces opposing each other in a length (L) direction, first and second side surfaces opposing each other in a width (W) direction, and upper and lower surfaces opposing each other in a thickness (T) direction, and may have a substantially hexahedral shape.

The body 1 may contain a magnetic material 11. The magnetic material may be any material that has magnetic properties. For example, the magnetic material may be ferrite or a material in which metal magnetic particles are filled in a resin, wherein the metal magnetic particle may contain one or more of iron (Fe), silicon (Si), chromium (Cr), aluminum (Al), and nickel (Ni).

The magnetic material in the body serves as a path for a magnetic flux generated by coil 12, so the magnetic material may completely encapsulate the coil, other than lead portions of the coil.

The coil 12 may be wound in an entirely spiral shape and include a first lead portion 121 connected to the first external electrode 21 and a second lead portion 122 connected to the second external electrode 22. The coil may include a plurality of coil patterns 12*a* and 12*b* wound in a spiral shape between the first and second lead portions as a main body of the coil.

The plurality of coil patterns 12*a* and 12*b* may be supported by a support member 13. The support member 13 may include a through hole H in a central portion thereof. Because the magnetic material is filled in the through hole, the magnetic flux generated from the coil may therefore be reinforced. The support member may contain a material having strength enough to suitably support the coil patterns, and the like, while having insulation characteristics. The shape of the support member is not particularly limited and may be a plate having a predetermined thickness for convenience of process. In consideration of the demand for a low profile inductor, the thickness of the support member may be about 60 μm or smaller. The support member may be, for example, a printed circuit board, an ABF film, or a PF-EL substrate, but is not limited thereto. The support member may further include a via hole for forming a via that electrically connects a coil pattern on the upper surface of the support member with a coil pattern on the lower surface of the support member in the vicinity of the through hole. There may be multiple via holes, and the shape of the via hole may be a tapered shape where the diameter increases in a direction from the center of the support member to the outside. However, the number and shape of via holes may be suitably selected by those skilled in the art as needed.

An insulator 14 may be supported on at least one surface of the support member, that is, at least one of the upper and lower surfaces 131 and 132 of the support member. The insulator 14 may include a predetermined first opening 14*h* with a spiral shape similar to the cross-sectional shape of the coil. The insulator 14 may serve as a plating guide line for plating growth of the coil and may serve to insulate adjacent coil patterns. The insulator 14 is configured to stably increase the aspect ratio of the coil, so the insulator may be formed with a larger thickness than the coil. When the insulator is thicker than the coil, a process of changing the thicknesses of the insulator and the coil to be equal to each other may be added. For example, after formation of the coil is completed, a portion of the insulator protruding from an upper surface of the coil may be at least partially removed by mechanical polishing or chemical polishing.

The insulator 14 may contain a permanent type photosensitive insulating material. For example, the insulator may contain a photosensitive material containing a bisphenol based epoxy resin as a main ingredient. The bisphenol based epoxy resin may be, for example, a bisphenol A novolac epoxy resin, a bisphenol A diglycidyl ether bisphenol A polymer resin, or the like, but is not limited thereto. Any material may be used as long as it is a general permanent type resist material.

A thin film conductor layer 15 may be formed on at least one of the upper and lower surfaces 131 and 132 of the support member. The thin film conductor layer may be formed in a shape corresponding to the cross-sectional shape of the coil. The thin film conductor layer may serve as a seed pattern at the time of plating growth of the coil. The thin film conductor layer 15 may have an entirely spiral shape. When viewed in an W-T cross section of the body, the thin film conductor layer may include first and second thin film conductor layers 151 and 152 spaced apart from each other in the W direction. With a spiral shape, the first and second thin film conductor layers 151 and 152 may also be spaced apart from each other in the L direction when viewed in an L-T cross section of the body. The first and second thin film conductor layers may be electrically connected to each other in a winding direction of the thin film conductor layer. That is, the first thin film conductor layer 151 may be an outer winding of the spiral shape and the second thin film conductor layer 152 may be an inner winding of the spiral shape, and the first and second thin film conductor layers may thus be contiguous when viewed in a plan view. The first and second thin film conductor layers 151 and 152 may be spaced apart from each other in the W direction by a predetermined second opening 15*h* between the first and second thin film conductor layers 151 and 152.

The positional relationship between the insulator 14 supported by the support member and the thin film conductor layer 15 will now be described with reference to FIGS. 1 and 2. The first thin film conductor layer 151 may have end portions 151*a* and 151*b*, and end portion 151*a* may be interposed between the insulator and the support member in the thickness direction, as shown in FIG. 2. Since the insulator is formed after the thin film conductor layer is formed, the thin film conductor layer may have a structure in which one end portion 151*a* thereof is covered by the insulator. The width of the portion of the first thin film conductor layer 151 from the end portion 151*a* covered by the insulator may be suitably selected by those skilled in the art. However, in order to prevent a short-circuit between the first thin film conductor layer 151 and another thin film conductor layer adjacent thereto, such as second thin film conductor layer 152, the width of the portion covered by the insulator may be less than half of the width of the lower surface of the insulator.

The opening 14*h* of the insulator 14 may be filled with a combination of the uncovered portion of the thin film conductor layer and the coil pattern. The thin film conductor layer 15 is not positioned in the center of the opening 14*h* but is biased toward one direction. Nevertheless, an upper surface of the coil pattern filling the opening 14*h* may be disposed to be substantially symmetrical.

The thin film conductor layer 15 may be a single layer or have a stacking structure in which a plurality of layers are stacked.

The thin film conductor layer 15 may have a stacking structure in which a plurality of layers are stacked and may include, for example, a copper clad laminate may be formed on one surface of the support member, a Cu layer may be formed on the copper clad laminate by a chemical plating method, and a Cu layer may be formed on the copper clad laminate by an electrical method, but the thin film conductor layer is not limited thereto. Of course, some of the metal layers in the stacking structure may be omitted.

The thin film conductor layer may be a single layer, and a specific method of forming the thin film conductor layer is not limited. For example, after entirely coating a metal layer on one surface of the support member using a sputtering method, patterning may be performed thereon using a laser. Alternatively, after entirely coating a conductive material on one surface of the support member using a electroplating or electroless chemical plating method, patterning may be performed thereon using a tenting method, or the like. The specific material capable of being used therein is not particularly limited. When forming the thin film conductor layer using a chemical method, the thin film conductor layer may be a metal layer formed of copper, nickel, tin, gold, or the like. When forming the thin film conductor layer using a sputtering method, the thin film conductor layer may be a coated copper layer or contain titanium and molybdenum. The thin film conductor layer may be formed by a printing method using a paste, and may be a metal layer formed of copper, silver, or the like.

In the inductor with a thin film conductor layer biased toward one direction, instead of being disposed in the center of the opening 14*h* and with one end portion 151*a* embedded below the insulator, a degree of freedom in process of patterning the insulator may be significantly increased. When the width of the opening of the insulator is narrow, that is, when a line width of the coil pattern is narrow, it may be difficult to maintain an alignment so that the entire thin film conductor layer is disposed in the opening of the insulator. However, when one end portion of the thin film conductor layer is interposed between the insulator and the support member, the alignment may be maintained by allowing a remaining portion of the thin film conductor layer to be disposed in the opening, and the degree of freedom in process may be maintained in spite of the narrow line width of the coil pattern.

There may be a deviation between heights H1 and H2 at which the upper surface of the coil pattern filled in the opening comes in contact with side surfaces of right and left insulators adjacent thereto. The deviation in heights may be caused by the thin film conductor layer being biased to one direction, such that the height of the coil pattern above the thin film conductor layer is larger than the height of the coil pattern where it is not above the thin film conductor layer. The deviation between heights H1 and H2 may preferably be equal to or less than 15% of an average height of the upper surface of the coil pattern. That is, a coil pattern 12*a* may fill an opening 14*h* between a first insulator 141 adjacent to the center of the body and a second insulator 142 toward an outer portion of the body. The deviation between the height H1 at which the upper surface of the coil pattern comes in contact with a side surface of the first insulator and a height H2 at which the upper surface of the coil pattern comes in contact with a side surface of the second insulator (i.e., H1−H2) may be preferably 15% or less than the average height of the upper surface of the coil pattern. When the deviation is more than 15%, the upper surface of the coil pattern may have a large inclination, such that the coil pattern may ride over the upper surface of the insulator, thereby increasing the risk of a short-circuit between adjacent coil patterns, and electrical properties such as withstand voltage characteristics, and the like, may be deteriorated.

Table 1 illustrates the short-circuit defect rate depending on the ratio R of the deviation (H1−H2) to the average height of the upper surface of the coil pattern. Sample numbers corresponding to Comparative Examples were marked by an asterisk in an upper right end.

TABLE 1

| Example No. | R | Short-circuit Defect Rate |
|---|---|---|
| 1 | 1.3% | 0.03 |
| 2 | 1.8% | 0 |
| 3 | 2.1% | 0 |
| 4 | 2.2% | 0.02 |
| 5 | 4.5% | 0.03 |
| 6 | 4.6% | 0.01 |
| 7 | 7.6% | 0.02 |
| 8 | 8.5% | 0 |
| 9 | 8.9% | 0 |
| 10 | 12.5% | 0.06 |
| 11 | 13.6% | 0.03 |
| 12 | 14.5% | 0.01 |
| 13 | 15.0% | 0.03 |
| 14* | 15.1% | 1.56 |
| 15* | 16.8% | 1.43 |
| 16* | 16.9% | 2.01 |
| 17* | 17.1% | 2.21 |
| 18* | 18.5% | 1.95 |
| 19* | 18.6% | 2.65 |
| 20* | 19.5% | 5.01 |
| 21* | 20.1% | 4.95 |

In inductors in Inventive Examples 1 to 13 of Table 1, the short-circuit defect rate was substantially insignificant, and the method of plating the coil pattern need not include a method described below. However, since the thin film conductor layer is not formed in the center of the opening but is biased to one side of the opening, the initial plating layer may excessively grow only toward the thin film conductor layer due to characteristics of plating growth, and the upper surface of the coil pattern may be inclined. Therefore, there is a need to use a method capable of overcoming these problems. One exemplary method capable of overcoming these problems is to increase a concentration of copper as compared to sulfuric acid in sulfuric acid and copper added to a plating solution and adding a solution capable of performing fill plating thereto, a promoter ingredient among solution additives may be non-uniformly adsorbed, such that a growth rate may be decreased and thus, a thickness variation may be decreased. Alternatively, when applying a current using a pulse/reverse rectifier, growth of a high current portion may be suppressed, and growth of a low current portion may be relatively increased, such that an entire shape of the coil pattern may be leveled.

Referring to FIG. 2, an insulating layer 16 may be further disposed on the upper surface of the coil pattern. Since the insulating layer 16 is to insulate the coil pattern and the magnetic material from each other, the insulating layer may contain a material having insulation properties. The insulating layer 16 may contain a different material from that of the insulator for insulating adjacent coil patterns from each other. The insulating layer may be disposed to be entirely coated on the upper surface of the coil pattern and the side surface and the upper surface of the insulator. A specific coating method is not particularly limited, but in order to obtain a thin and uniform insulating layer, an insulating resin including parylene may be coated by a chemical vapor deposition method.

Figure 3:
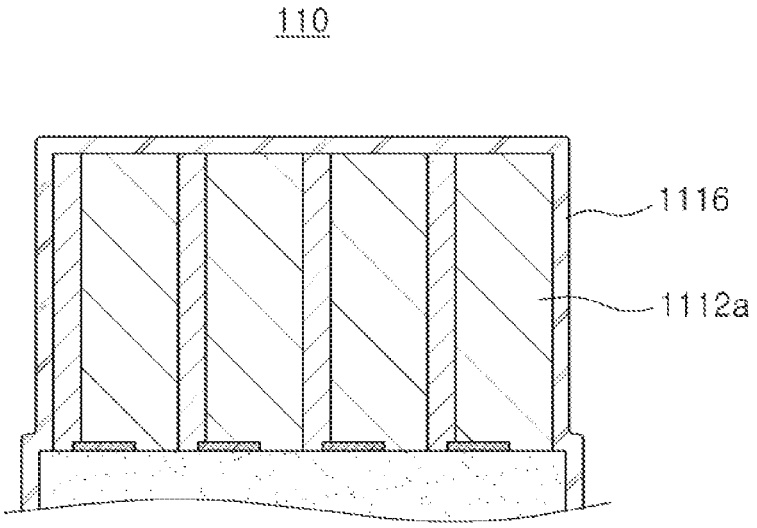
FIG. 3 is a cross-sectional view of a first modified example of the inductor according to the first exemplary embodiment.

FIG. 3 is a cross-sectional view of an inductor 110 according to a first modified example of the inductor 100 according to the first exemplary embodiment illustrated in FIGS. 1 and 2. For convenience of explanation, differences from the inductor described with reference to FIGS. 1 and 2 will be mainly described, and similar aspects will be described based on the same reference numerals as in FIGS. 1 and 2.

Referring to the inductor 110 illustrated in FIG. 3, an inner side surface of an innermost coil pattern 1112*a* does not come in contact with an insulator but may instead come in direct contact with an insulating layer 1116. An insulator supporting the inner side surface of the innermost coil pattern may be removed, and the insulating layer may be formed at a position at which the insulator is removed. The thickness of the insulating layer may be about 10 to 20 μm, which is relatively thinner than a thickness of an insulator for insulating adjacent coil patterns from each other. As a result, the space in which a magnetic material may be filled in the center of the core of the coil may be significantly secured, and permeability of the inductor may be increased. A method of selectively removing the insulator coming in contact with the inner side surface of the innermost coil pattern and disposing the insulating layer 1116 is not limited. For example, the insulator may be removed by a laser, and the insulating layer 1116 may be continuously disposed up to the upper surface of the insulator as well as the upper surface of the coil pattern by a chemical vapor deposition (CVD) method using an insulating resin containing an insulating material.

Figure 4:
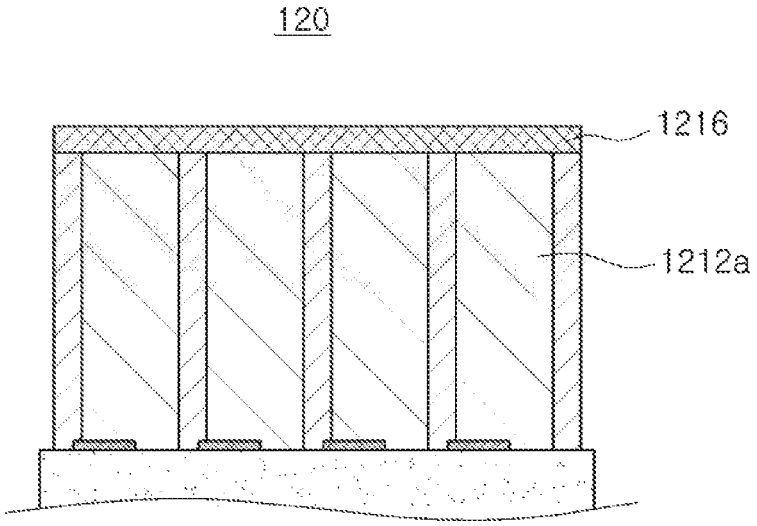
FIG. 4 is across-sectional view of a second modified example of the inductor according to the first exemplary embodiment.

FIG. 4 is a cross-sectional view of an inductor 120 according to a second modified example of the inductor 100 according to the first exemplary embodiment illustrated in FIGS. 1 and 2. For convenience of explanation, differences from the inductor described with reference to FIGS. 1 and 2 will be mainly described, and similar aspects will be described based on the same reference numerals as in FIGS. 1 and 2.

In the inductor 120 of FIG. 4, an insulating layer 1216 is not extended to come in contact with the support member and may instead be laminated on an upper surface of the coil and an upper surface of the insulator. The insulating layer 1216 may be formed by laminating an insulating resin having a film shape on the upper surface of the coil and the upper surface of the insulator, thereby insulating the coil and from the magnetic material. The insulating layer may be formed so that both end portions thereof are positioned on the same lines as an innermost portion of an insulator disposed in an innermost portion of a body and an outermost portion of an insulator disposed in an outermost portion of the body, respectively. As long as an insulation function between the coil pattern and the magnetic material from each other is not deteriorated, both end portions of the insulating layer may be at least partially formed to be shorter in a direction adjacent to the upper surface of the coil pattern.

Figure 5:
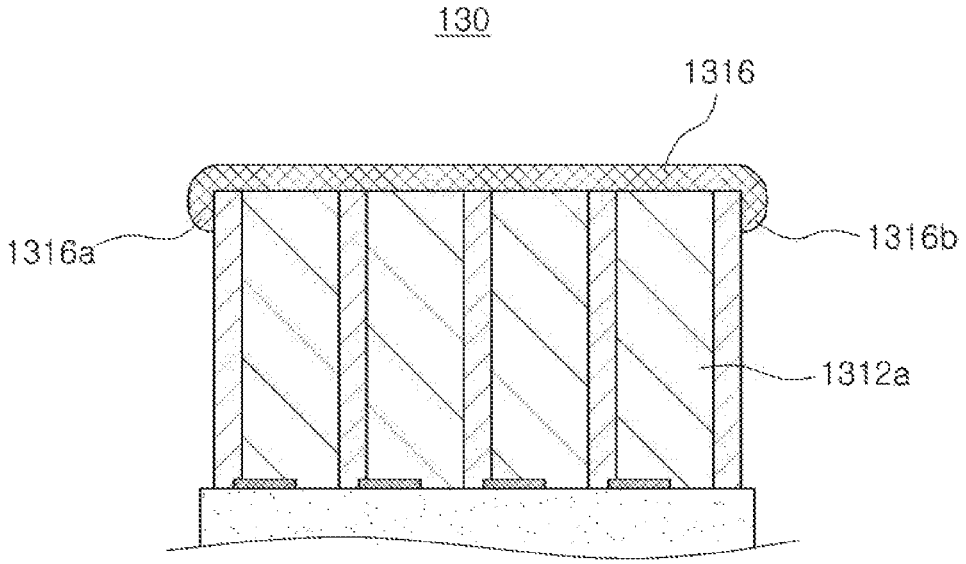
FIG. 5 is a cross-sectional view of a third modified example of the inductor according to the first exemplary embodiment.

FIG. 5 is a cross-sectional view of an inductor 130 according to a third modified example of the inductor 100 according to the first exemplary embodiment illustrated in FIGS. 1 and 2. For convenience of explanation, differences from the inductor described with reference to FIGS. 1 and 2 will be mainly described, and similar aspects will be described based on the same reference numerals.

Similar to the inductor 120 of FIG. 4, in the inductor 130 of FIG. 5, an insulating layer 1316 may be laminated on an upper surface of a coil pattern. However, at least one of the end portions 1316*a* and 1316*b* of the insulating layer 1316 may respective extend toward the center of the core or an external surface of a body. Although FIG. 5 illustrates the end portions 1316*a* and 1316*b* extending from an inner side surface of an innermost insulator and an outer side surface of an outermost insulator, respectively, only one the end portions may be extended.

Insulation properties may be reinforced by extending at least one of the end portions of the insulating layer. Fixation force of the insulating layer may be increased by extending the insulating layer 1316 in order to prevent an insulation defect from occurring due to delamination between the insulating layer and the insulator or between the insulating layer and the coil pattern while the inductor is used or produced.

Figure 6:
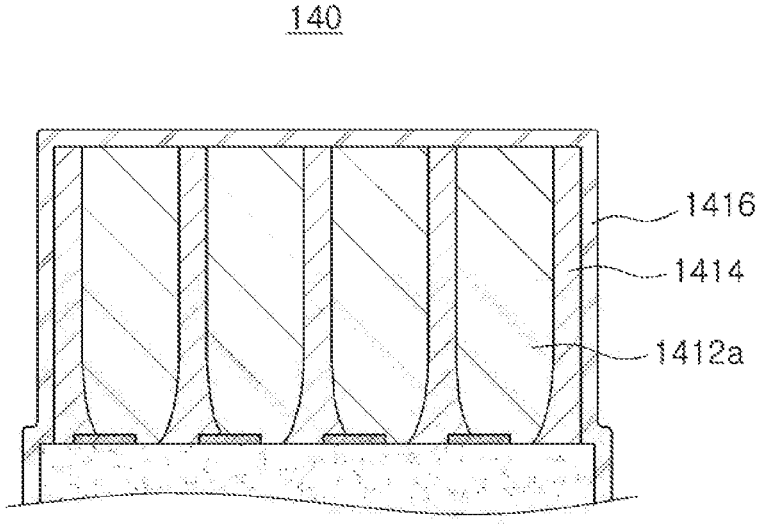
FIG. 6 is a cross-sectional view of a fourth modified example of the inductor according to the first exemplary embodiment.

FIG. 6 is a cross-sectional view of an inductor 140 according to a fourth modified example of the inductor 100 according to the first exemplary embodiment illustrated in FIGS. 1 and 2. For convenience of explanation, differences from the inductor described with reference to FIGS. 1 and 2 will be mainly described, and similar aspects will be described based on the same reference numerals as in FIGS. 1 and 2.

Referring to the inductor 140 of FIG. 6, the width of the insulator 1414 may be increased in a direction toward the support member. Decreasing the width of the insulator 1414 allows for the number of turns of the coil pattern to be relatively increased in a miniaturized inductor. However, as the width of the insulator is decreased, there is a difficulty in controlling a thin film conductor layer to be at least partially disposed on a lower surface of the insulator. Therefore, in the inductor 140, the thin film conductor layer may be interposed between the lower surface of the insulator and the support member and the insulator may be controlled to have a thinner width by allowing the width of the lower surface of the insulator at least partially covering end portions of the thin film conductor layer to be wider than that of an upper surface thereof.

With the inductor described above, at the time of implementing a coil pattern with a fine line width, the degree of freedom in alignment between the insulator for insulating adjacent coil patterns from each other and the thin film conductor layer corresponding to the seed pattern of the coil pattern may be increased, and inductance may be significantly improved by enabling a coil pattern with a thinner line width.

Second Exemplary Embodiment

Figure 7:
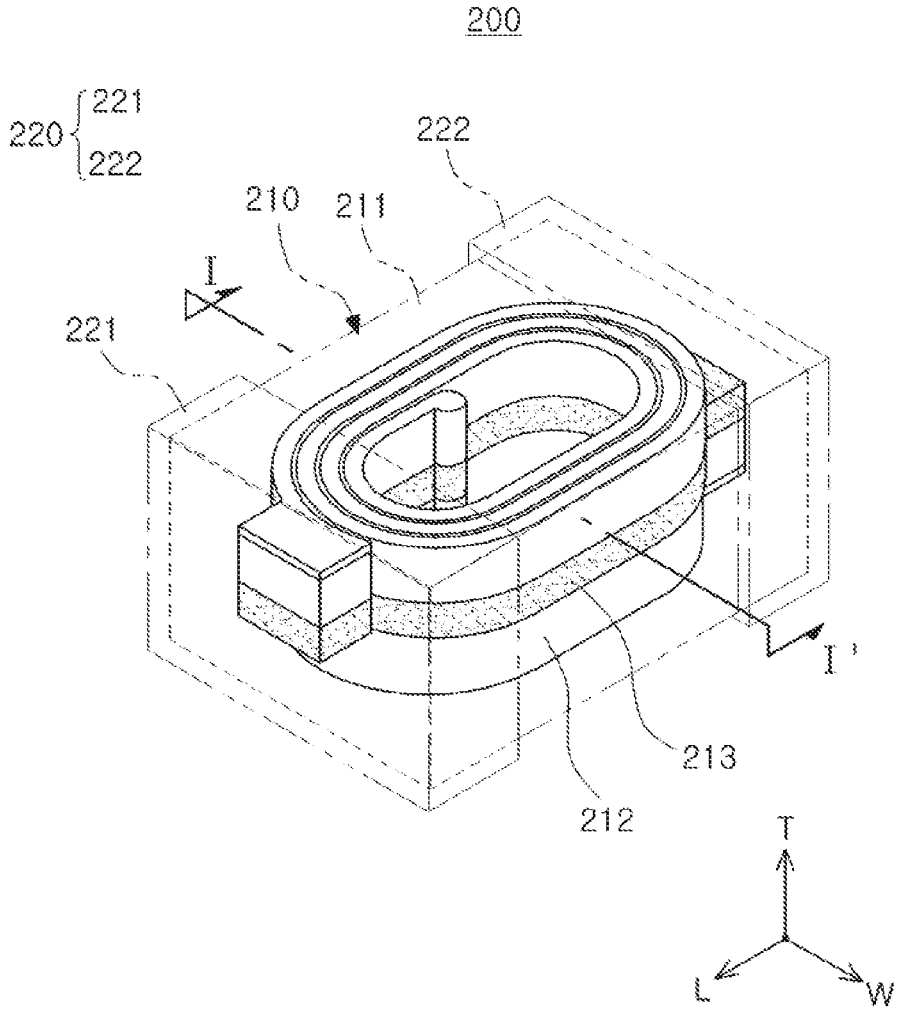
FIG. 7 is a schematic perspective view of an inductor according to a second exemplary embodiment in the present disclosure.
Figure 8:
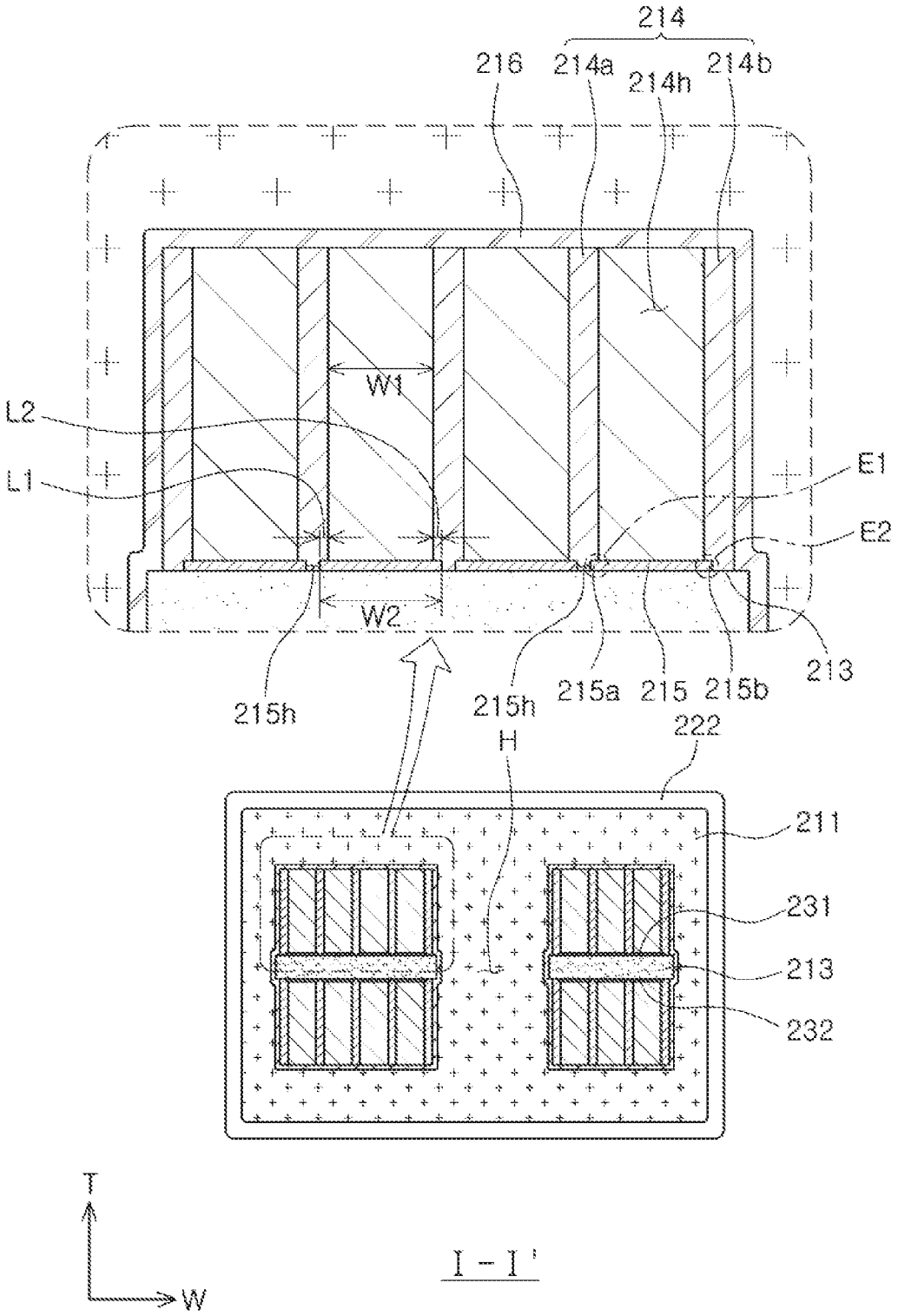
FIG. 8 is a cross-sectional view taken along line I-I' of FIG. 7.

FIG. 7 is a schematic perspective view of an inductor 200 according to a second exemplary embodiment in the present disclosure. FIG. 8 is a cross-sectional view of taken along line I-I' of FIG. 7. For convenience of explanation, a description of contents overlapping those of the inductor according to the first exemplary embodiment and the modified examples are omitted.

Referring to FIGS. 7 and 8, an inductor 200 may include a body 210 and external electrodes 220 disposed on an external surface of the body. The external electrodes may include a first external electrode 221 on a first end surface of the body and a second external electrode 222 on a second end surface of the body.

The body 210 includes a magnetic material 211, a coil 212 encapsulated by the magnetic material, a support member 213 supporting the coil, an insulator 214 insulating coil patterns in the coil from each other, and an insulating layer 216. A thin film conductor layer 215 serving as a base of plating growth may be disposed on a lower surface of the coil pattern.

In inductor 200, both end portions 215*a* and 215*b* of the thin film conductor layer 215 may be covered by the insulator. An entire opening 215*h* of the thin film conductor layer 215 may be filled with the insulator 214.

Lengths L1 and L2 of portions of the thin film conductor layer covered by the insulator may be equal to each other and both end portions may be symmetrical to each other, but the covered portions of the thin film conductor layer are not limited thereto. The lengths L1 and L2 may be different from each other as long as a short-circuit does not occur between adjacent thin film conductor layers.

The insulator 214 may include first and second insulators 214*a* and 214*b* adjacent to each other and facing each other in a W-T cross section of the body. A lower portion of an opening 214*h* between the first and second insulators may be filled with the thin film conductor layer, and the coil patterns may be filled thereon. In this case, an edge portion E1 formed at a side surface of the first insulator 214*a* and an upper surface of the support member 213 may be substantially filled with the thin film conductor layer, and an edge portion E2 formed by a side surface of the second insulator 214*b* and the upper surface of the support member 213 may be substantially filled with the thin film conductor layer. Here, the corresponding edge portion is substantially filled, which means that a significant void is not formed therein. The void is a kind of plating defect that may make it difficult to implement the desired cross-sectional shape of the coil pattern, may deteriorate electrical properties, such as a direct current resistance loss, and the like, and may increase the possibility of a leaning defect or delamination of the insulator. However, in the inductor 200, since the void is not formed in the edge portions E1 and E2, the above-mentioned plating defect does not occur.

Referring to FIGS. 7 and 8, the opening 215*h* of the thin film conductor layer may be filled only by the insulator 214. More specifically, a thin film conductor layer having an opening pattern may be formed, one or more layers of an insulating sheet having insulation properties may be laminated in order to form the insulator, and then the insulator may be patterned so that a width W1 of the opening 214*h* of the insulator is narrower than a width W2 of the thin film conductor layer and so that both end portions of the thin film conductor layer are covered by the insulator. In this case, the method of patterning the insulator is not limited, but in consideration of physical properties of the insulating sheet for forming the insulator, an exposure and development method or a laser method may be applied. However, the method of pattering the insulator is not limited thereto.

Further, an upper surface of the insulator 214 and an upper surface of the coil 212 may be enclosed by the insulating layer 216. The insulating layer is described with respect to the inductor 100 illustrated in FIGS. 1 and 2, and a separate description thereof is omitted.

Figure 9:
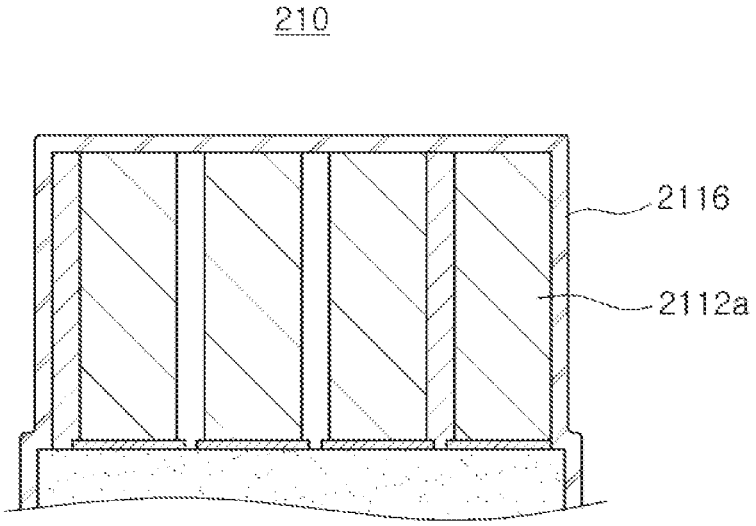
FIG. 9 is a cross-sectional view of a first modified example of the inductor according to the second exemplary embodiment.

FIG. 9 is a cross-sectional view of an inductor 210 according to a first modified example of the inductor according to the second exemplary embodiment in the present disclosure. The inductor illustrated in FIG. 9 may be distinguished from the inductor illustrated in FIGS. 7 and 8 in that among the insulators, an insulator coming in contact with an inner side surface of an innermost coil pattern is removed and the inner side surface of the innermost coil pattern and an insulating layer come in direct contact with each other. The modified example of the inductor according to the second exemplary embodiment includes a similar modification as in the first modified example of the inductor according to the first exemplary embodiment, so a detailed description thereof is omitted.

Figure 10:
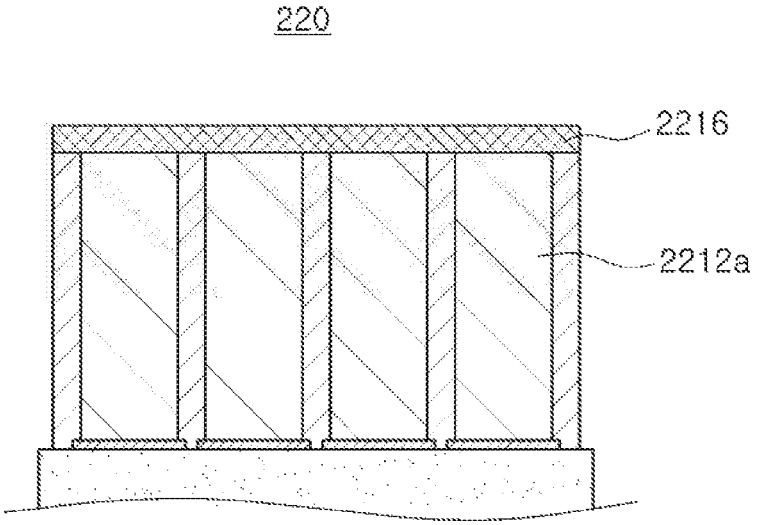
FIG. 10 is a cross-sectional view of a second modified example of the inductor according to the second exemplary embodiment.
Figure 11:
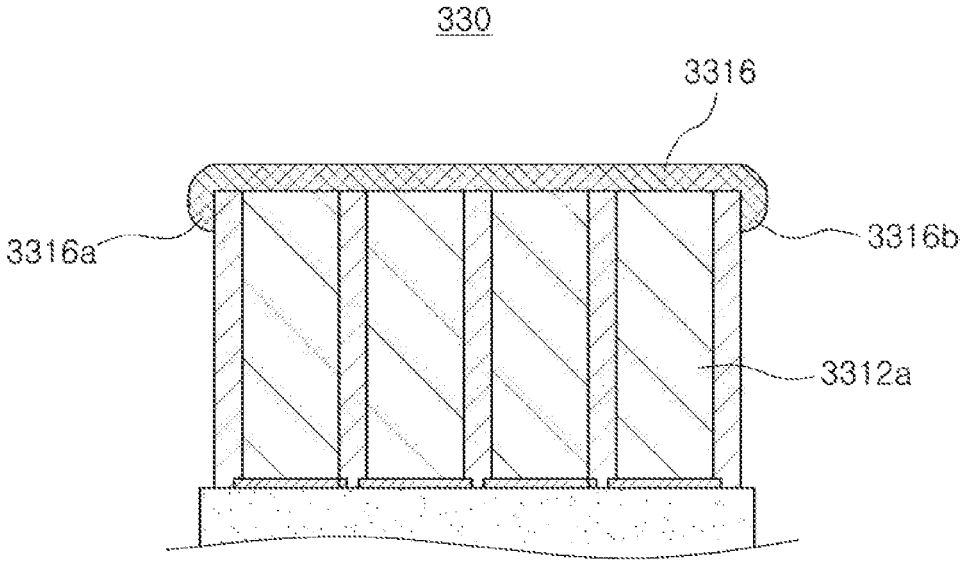
FIG. 11 is across-sectional view of a third modified example of the inductor according to the second exemplary embodiment.
Figure 12:
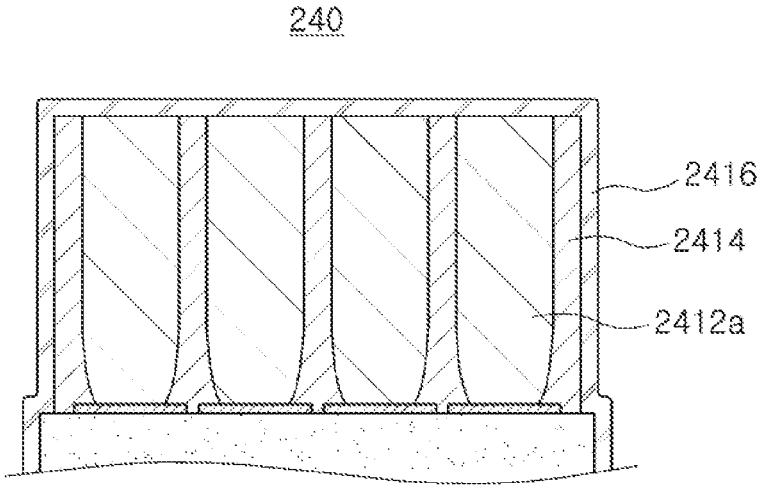
FIG. 12 is a cross-sectional view of a fourth modified example of the inductor according to the second exemplary embodiment.

Similarly, an inductor 220 of FIG. 10 includes a similar modification as in the inductor 120 of FIG. 4, an inductor 230 of FIG. 11 includes a similar modification as in the inductor 130 of FIG. 5, and an inductor 240 of FIG. 12 includes a similar modification as in the inductor 140 of FIG. 6. Therefore, detailed descriptions of the inductors 220, 230, and 240 of FIGS. 10 through 12 are omitted.

As set forth above, according to exemplary embodiments in the present disclosure, in the miniaturized inductor, the aspect ratio of the coil pattern may be increased, and electrical characteristics such as Rdc characteristics and inductance characteristics may be improved.

While exemplary embodiments have been shown and described above, it will be apparent to those skilled in the art that modifications and variations could be made without departing from the scope of the present invention as defined by the appended claims.

What is claimed is:

1. An inductor comprising:

a body including a support member, an insulator on the support member and including a first opening, a coil in the first opening, and a thin film conductor layer between the coil and the support member and including a second opening; and a first external electrode on a first external surface of the body and a second external electrode on a second external surface of the body, wherein at least one end portion of the thin film conductor layer is between the support member and the insulator, and wherein the insulator includes first and second insulator portions adjacent to each other across the first opening, and a deviation between a thickness H1 of the coil at the first insulator portion and a thickness H2 of the coil at the second insulator portion, is equal to or less than 15% of an average thickness of the coil.

2. The inductor of claim 1, wherein the second opening is filled with the insulator and the coil.

3. The inductor of claim 1, wherein the thin film conductor layer is a single layer.

4. The inductor of claim 3, wherein the thin film conductor layer contains one of copper, nickel, tin, gold, titanium, molybdenum, and silver.

5. The inductor of claim 1, wherein the thin film conductor layer has a stacking structure composed of a plurality of layers.

6. The inductor of claim 5, wherein the plurality of layers have the same line width as each other.

7. The inductor of claim 1, wherein in the second opening, a portion of a lower surface of the coil pattern comes into direct contact with the support member.

8. The inductor of claim 1, wherein an insulating layer is on an upper surface of the coil pattern.

9. The inductor of claim 8, wherein the insulating layer extends inwardly from an innermost side surface of the insulator or extends outwardly from an outermost side surface of the insulator.

10. An inductor comprising:

a support member;

an insulator on the support member and including a first opening;

a coil in the first opening, between first and second insulator portions adjacent to each other across the first opening, with a lower surface having a first portion in direct contact with the support member; and a thin film conductor layer on the support member, between the support member and a second portion of the lower surface of the coil, and including an end portion below the first insulator portion;

wherein the coil has an upper surface that inclines from a thickness H1 at the first insulator portion to a thickness H2 at the second insulator portion, where a deviation between H1 and H2 is equal to or less than 15% of an average thickness of the coil.

11. The inductor of claim 10, further comprising:

a magnetic material encapsulating the support member, the insulator, the coil, and the thin film conductor layer; and an insulating layer above the insulator and between the magnetic material and upper surfaces of the insulator and coil, wherein the insulating layer is in direct contact with an innermost or outermost side surface of the coil.

12. The inductor of claim 11, wherein at least a portion of an innermost or outermost side surface of the insulator is in direct contact with the magnetic material.

13. The inductor of claim 10, wherein a width of the first and second insulator portions increases in a direction toward the support member.

14. An inductor comprising:

a support member;

an insulator on the support member and including a first opening;

a coil in the first opening, between first and second insulator portions adjacent to each other across the first opening, with a lower surface having a first portion in direct contact with the support member; and a thin film conductor layer on the support member, between the support member and a second portion of the lower surface of the coil;

wherein the coil has an upper surface that inclines from a thickness H1 at the first insulator portion to a thickness H2 at the second insulator portion, where a deviation between H1 and H2 is equal to or less than 15% of an average thickness of the coil.

15. The inductor of claim 14, further comprising:

a magnetic material encapsulating the support member, the insulator, the coil, and the thin film conductor layer; and an insulating layer above the insulator and between the magnetic material and upper surfaces of the insulator and coil, wherein the insulating layer is in direct contact with an innermost or outermost side surface of the coil.

16. The inductor of claim 15, wherein at least a portion of an innermost or outermost side surface of the insulator is in direct contact with the magnetic material.

17. The inductor of claim 14, wherein a width of the first and second insulator portions increases in a direction toward the support member.

* * * * *